United States Patent [19]

Forcier

[11] 4,440,512

[45] Apr. 3, 1984

[54] DAISY WHEEL PRINTER HAVING LOW MASS CARRIAGE

[76] Inventor: Mitchell D. Forcier, 14007 SE. 30th St., Apt. H, Vancouver, Wash. 98664

[21] Appl. No.: 385,849

[22] Filed: Jun. 7, 1982

[51] Int. Cl.[3] ..... B41J 1/30

[52] U.S. Cl. ..... 400/144.2; 101/93.19; 400/903

[58] Field of Search ..... 400/144.2, 144.3, 903, 400/320, 322, 328; 101/93.17, 93.19

[56] References Cited

U.S. PATENT DOCUMENTS

| | | | |
|---|---|---|---|
| 3,542,182 | 11/1970 | Langenberger | 400/144.3 X |
| 3,651,916 | 3/1972 | Becchi | 400/144.3 |
| 3,698,529 | 10/1972 | Cattaneo | 400/144.3 X |
| 3,760,925 | 9/1973 | Bossi | 400/144.3 |
| 3,773,161 | 11/1973 | Bossi | 400/144.3 |
| 3,908,809 | 9/1975 | Beattie | 400/144.3 |
| 4,044,880 | 8/1977 | Martin | 400/144.3 X |
| 4,101,006 | 7/1978 | Jensen et al. | 400/144.3 |
| 4,145,739 | 3/1979 | Dunning et al. | 364/200 |
| 4,245,917 | 1/1981 | Mosciatti et al. | 400/144.2 |

FOREIGN PATENT DOCUMENTS

| | | | |
|---|---|---|---|
| 55-34942 | 3/1980 | Japan | 400/144.2 |

OTHER PUBLICATIONS

*Hewlett-Packard Journal,* vol. 27, No. 10, pp. 19–33, Jun. 1976, by R. B. Bump, 400–144.2.

*Primary Examiner*—Paul T. Sewell

*Attorney, Agent, or Firm*—Klarquist, Sparkman, Campbell, Leigh & Whinston

[57] ABSTRACT

A daisy wheel printer with a low mass carriage is driven by a pair of bidirectional stepping motors mounted on the printer frame. The carriage and print wheel are each driven by their respective motor through a belt and pulley drive extending side to side of the printer frame. The motors and pulleys are proportioned so that a step of either stepping motor rotates the print wheel from one character position to the next, thereby synchronizing print wheel rotation with carriage movement. The motors are driven independently, under control of a microcomputer in the printer, to vary the phase of rotation of the print wheel relative to movement of the carriage. Stops at one end of the printer frame are used to physically position the carriage and wheel to known initial locations. The microcomputer is programmed to electrically synchronize the motor controls to such locations and to track the positions of the print wheel and carriage when moving them from their initial locations, without using extrinsic position-sensing and control circuitry. The printer has a platen mounted on a rack which is pivotable by rotatable cams away from the print wheel to ease removal of the wheel and to optimally adjust the platen-to-wheel spacing for printing on papers of different thicknesses.

3 Claims, 9 Drawing Figures

FIG. 1
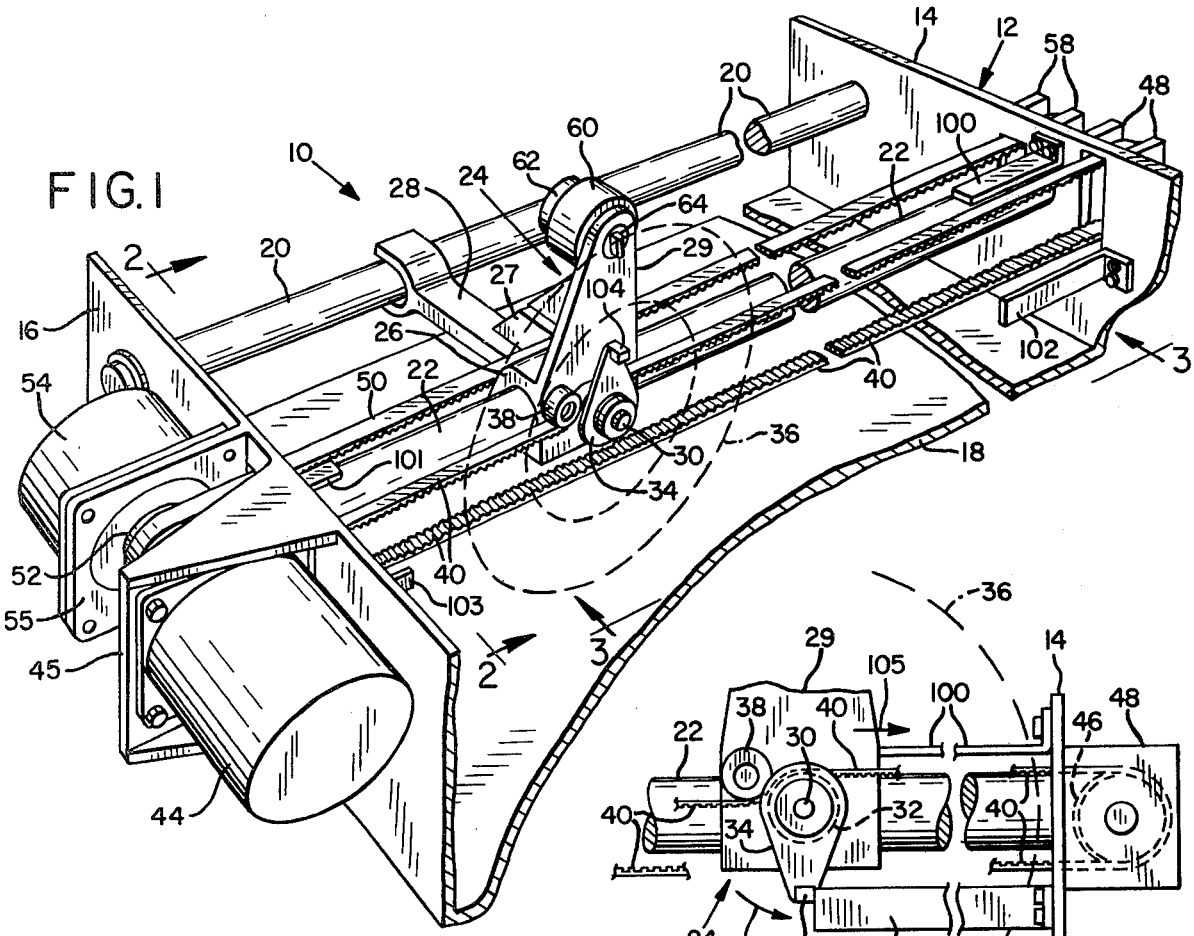
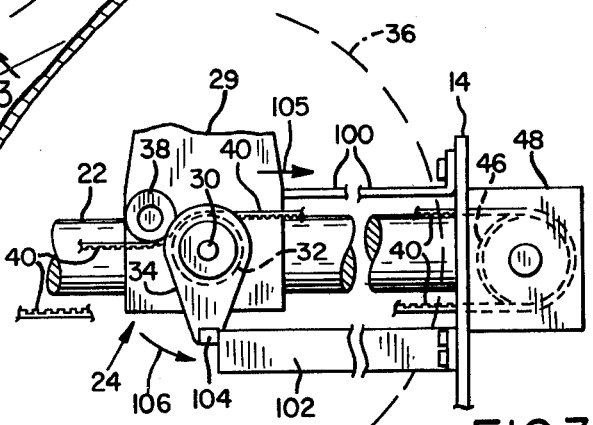
FIG. 3
FIG. 2
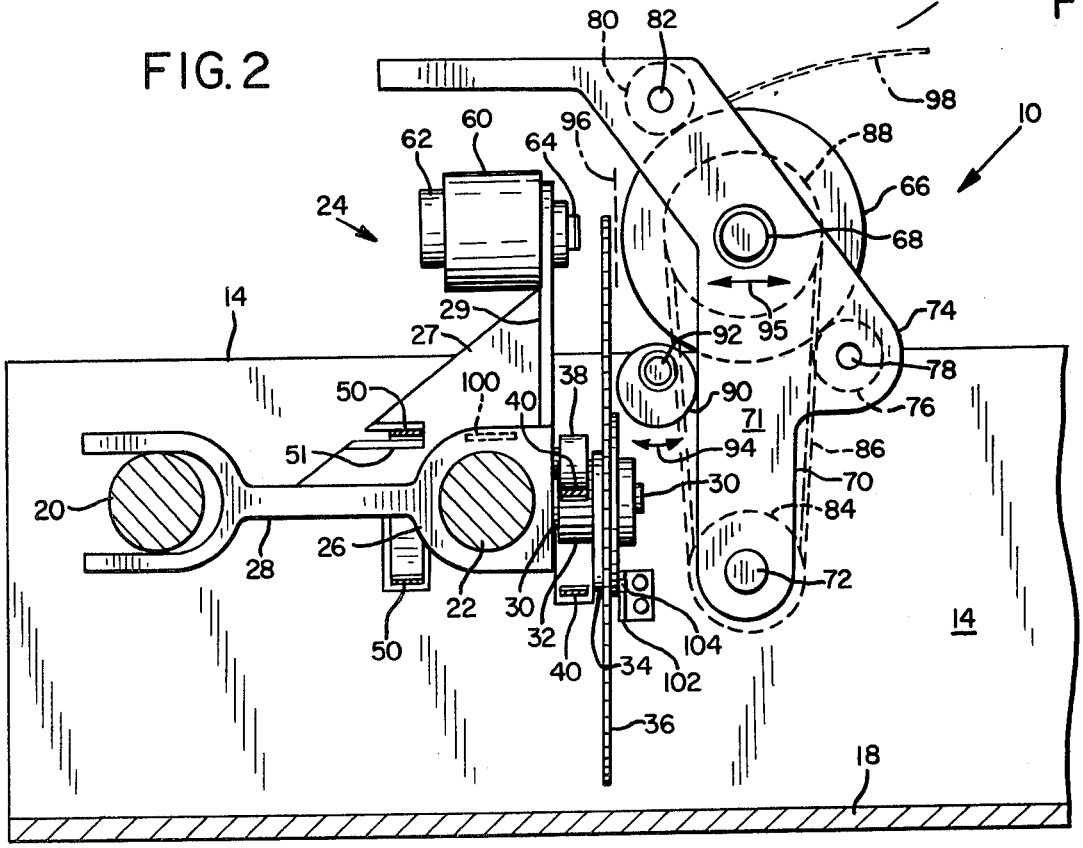

DAISY WHEEL PRINTER HAVING LOW MASS CARRIAGE

BACKGROUND OF THE INVENTION

This invention relates generally to rotary serial character printers and more particularly to impact printers having a print wheel mounted on a movable carriage, commonly referred to as "daisy wheel" printers.

Daisy wheel printers conventionally have a printer carriage bearing a rotatable print wheel. The carriage is mounted on a frame structure for side-to-side movement along a platen to shift the print wheel from one print position to the next along a horizontal print line. Such printers include a print wheel drive mechanism for rotating the print wheel to angularly position a petal of the wheel in the print line. A striker mechanism mounted on the carriage strikes the petal to impact it against the platen and thereby create an image on paper of the character borne on the petal. Coordination of movement of the carriage, rotation of the print wheel and operation of the striker requires precise control of both position and timing of operation of the various elements of the printer. In a quest for ever-faster printing speeds, while retaining the inherently superior quality of impact-generated characters, a variety of rotary printer designs have been proposed.

Among early designs are U.S. Pat. Nos. 3,542,182 to Langenberger; 3,651,916 to Becchi; and 3,698,529 to Cattaneo. Each of these patents uses a step-type drive mechanism for advancing a movable carriage along a platen. The carriage mounts a print wheel, which is continuously rotated asynchronously of the carriage in one direction through either a gear or a pulley drive. All of these designs use some form of photoelectric or conductive synchronization circuitry for sensing print wheel position and actuating the striker at a proper instant relative to the angular position of the constantly rotating print wheel to print a preselected character. The primary difficulty with devices of this type is that striking a fast-moving petal causes the image to smear. Smearing reduces the quality of printed character at high print speeds, thereby limiting the maximum printing speed of continuously-moving wheel-type printers. Accurately controlling the operation of the striker is essential to avoid mistriking the fast-moving petals. It imposes very stringent response and timing requirements on the striker which also make it difficult to further increase printing speed. Hence, it would be preferable to slow or stop the wheel momentarily during striking. At the same time, it would be desirable to dispense with the need for extrinsic synchronization circuitry.

Later printers, such as those disclosed in U.S. Pat. Nos. 3,760,925 and 3,773,161 to Bossi are of the synchronous type, that is, printer carriage motion is mechanically synchronized with the motion of the print wheel, which is continuously rotated in a single direction. However, mechanically synchronizing the carriage and print wheel limits the choice of spacing between letters to a pitch equal to the pitch of the screw drive of the carriage. This arrangement interferes with proportionally spacing the letters and virtually precludes graphics. An additional disadvantage of rotating the print wheel in only one direction is that it must rotate as much as a full turn between characters. It is preferable to be able to rotate the print wheel in either direction, by at most half a turn, independently of movement of the carriage, to position a next character in the printing position along the platen. This is clearly incompatible with a mechanically-synchronized carriage and print wheel of the type disclosed in the Bossi patents.

More recent printer designs have returned to a fully asynchronous relationship between the carriage drive and the print wheel drive. U.S. Pat. Nos. 4,044,880 to Martin and 4,101,006 to Jensen, et al. each disclose a step motor driving the carriage from side to side through a belt and pulley arrangement. A second motor rotates the print wheel through a pair of bevel gears, one of which is slidingly mounted on a splined drive shaft of the print wheel motor. U.S. Pat. No. 3,908,809 to Beattie is similar, but uses a constant speed carriage drive motor in combination with a stepper motor which acts as an intermittent brake on the continuous translational movement of the carriage. In Martin and Beattie, the print wheel motor rotates continuously in one direction and printing occurs on the fly, with both the wheel and carriage moving. In Jensen, et al, the print wheel drive motor is a stepping motor but otherwise operates mechanically much like Martin. Both Martin and Jensen, et al. use a toothed magnetic emitter wheel and sensor to sense the angular position of the print wheel and control firing of the striker, similar to the aforementioned Cataneo and Becchi patents. Beattie suggests using a similar arrangement to monitor carriage position.

As mentioned above, operation in Martin, Beattie and Jensen, et al. of the carriage and print wheel motors is asynchronous. The carriage and print wheels are moved independently of one another. As the carriage moves, the bevel gear mounted on splined shaft of the print wheel step motor merely slides along the shaft. This mechanical arrangement is superior to those of prior asynchronous designs but still suffers from several disadvantages. First, the gears must be highly precise both in construction and in their positioning relative to one another. Properly meshing bevel gears necessarily involves a trade off between accuracy of print wheel position and vulnerability to backlash on one hand and friction or binding between the gear teeth on the other hand. Friction between the movable bevel gear and the splined shaft is also desirably minimized in high-speed printers, but the ability to do so is limited by the adverse effect on print wheel positioning accuracy of too much play in the splined shaft-to-gear interface. These concerns would be greatest if the print wheel motor were driven bidirectionally to minimize the angle of rotation to a desired character.

Both of the foregoing problems tend to worsen as the printer is used over a period of time; the gear teeth wear and the spline contacting surfaces of the movable bevel gear wear. These problems also become more critical as printing speed and the number of characters on a print wheel are increased. Angular errors that are relatively small, for example, 1°, in print wheels having small character sets, such as 36 characters spaced 10° apart, become relatively large when the character set is increased, for example, to 96 characters spaced less than 4° apart.

To overcome the foregoing objections, some printers currently on the market, such as the Wang Model 6581-W, utilize a DC SERVO motor, with sensor and feedback circuitry, mounted on the carriage to directly drive the print wheel. Far greater accuracy of angular positioning of the print wheel is thus made possible.

However, it is obtained at the cost of greatly increasing the mass of the carriage. As a result, the speed at which the carriage can be stepped accurately along the print line from one print position to the next is limited.

U.S. Pat. No. 4,245,917 to Mosciatti, et al. seeks to minimize carriage mass by using instead of motors, a fixed linear magnet core mounting four separate armature coils for independent movement along the core to operate various printer elements. In general, this printer is asynchronous like Martin and Jensen, et al., but is much more complicated and heavier. Instead of bevel gears, Mosciatti, et al. use a rack and pinion which is also susceptible to backlash. They also use a photoelectric transducer to monitor print wheel position.

It would be preferable to obtain the angular accuracy of a direct drive step motor rotating the print wheel in either direction without the disadvantage of carrying the mass of such motor on the carriage. It would also be desirable to have the certainty, provided in synchronous printers, of knowing the relative position of the print wheel and carriage without the need for feedback circuitry, while having the flexibility of control of asynchronous printers. However, no known printer provides these capabilities or avoids all of the foregoing problems without introducing some other countervailing problem. Accordingly, there remains a need for an improved rotary serial printer.

SUMMARY OF THE INVENTION

One object of the invention is to improve the throughput of rotary serial printers over that now attainable.

A second object of the invention as aforesaid is to maintain a high quality of character production, particularly to minimize character smearing.

Another object of the invention is to attain very high printing speeds, for example, 100 characters per second, from rotary serial printers while accurately controlling the positioning of characters along a print line.

A further object is to obtain the desirable characteristics of both synchronous and asynchronous printers while minimizing their respective undesirable characteristics.

Another object is to bidirectionally drive the print wheel from a motor mounted on the printer frame, yet minimize play in the print wheel sufficiently to print at high speed from large character sets.

An additional object of the invention is to eliminate the need for sensing means and control circuitry for sensing wheel and carriage position and controlling the striker.

The invention is a printer comprising a first drive means driving a carriage, bearing a rotary print wheel, back and forth along a frame means, and means coupling the first drive means to the print wheel so that the wheel is rotated synchronously, or in a fixed phase relationship, with movement of the carriage. A second drive means, including a bidirectional motor means, is mounted on the frame means, apart from the carriage, for rotating the print wheel independently of the first drive means to vary the relative phase of the carriage and print wheel.

In a preferred embodiment, one aspect of the invention provides for the print wheel to be driven by a stepping motor through a belt extending parallel to the direction of movement of the carriage. Movement of the carriage by the first motor means induces relative motion between the print wheel and the belt, rotating the wheel synchronously with movement of the carriage. Operating the stepping motor independently of the first motor means superimposes a second component of rotation on the print wheel so that the angular rotation of the wheel is proportional to the algebraic sum of the movement of the carriage and the movement of the belt by the stepping motor. Preferably, the first and second drive means are both bidirectional stepping motor and belt drives, proportioned so that stepping the carriage drive motor rotates the print wheel by an amount equal to the rotation produced by an integral number of steps of the print wheel drive motor. In this context, it should be understood that a step is a discrete angle of rotation through which the motor is indexed by a control circuit or computer program, and can be composed of a fraction or integral multiple of true steps of a stepping motor.

Because movement of the carriage and rotation of the wheel are synchronized, their position may be tracked by logic circuitry controlling the operation of the motors without need for sensing and feedback circuitry monitoring the physical position of the carriage or print wheel. At the same time, the flexibility of asynchronous printers is provided by the independent operation of the first and second drive means. Moreover, the preferred form of drive means greatly reduces the range of error in positioning the print wheel while obtaining the advantages of bidirectional rotation of such wheel in reducing the distance that the print wheel must rotate from one character to the next.

In another aspect of the invention, the printer includes initialization means comprising stop means for stopping further movement of the carriage at one side of the frame means and wheel stop means for stopping rotation of the print wheel at a selected angular position for synchronizing the carriage, print wheel, and control circuitry at a specified initial position. The control circuitry preferably includes a microcomputer programmed to track the position of the carriage and print wheel, control the step motor, ribbon, and striker drive circuits, coordinate the movements of the carriage and print wheel, and alter their operation in accordance with selected character spacing or pitch.

In a further aspect of the invention, a platen positioned along the path of the carriage is mounted on a rack which is pivotally connected to the frame means for rocking the platen away from the print wheel to ease removal of the wheel. A camming means engaging the rack is rotatable for moving the platen to a selected distance from the print wheel for printing. In this way, the platen can be positioned at an optimum distance from the print wheel for forming the best image on paper of different thicknesses. This features is particularly useful in printing carbon copies.

The foregoing and other objects, features and advantages of the invention will become more readily apparent from the following detailed description of a preferred embodiment.

BRIEF DESCRIPTION OF DRAWINGS

FIG. 1 is a perspective view from above and to the right rear of a printer in accordance with the invention, the ribbon and platen and their respective drives being omitted for clarity and the print wheel being shown in phantom lines.

FIG. 2 is a cross-sectional view taken along lines 2—2 in FIG. 1, showing the print wheel and a preferred form of platen in a side elevational view.

FIG. 3 is a rear elevational view of an end portion of the printer taken along line 3—3 in FIG. 1 showing the carriage and print wheel against their respective end stops.

DETAILED DESCRIPTION OF A PREFERRED EMBODIMENT

Overall Mechanical Arrangement

Figure 4:
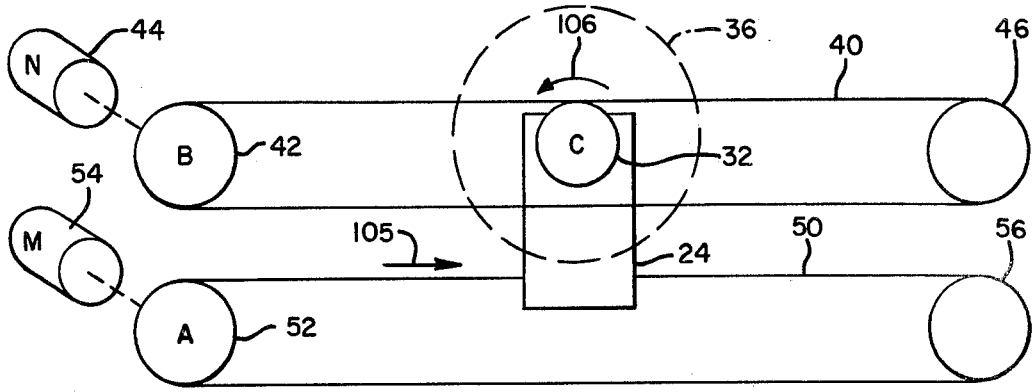
FIG. 4 is a schematic of the carriage and print wheel drive arrangement of the printer of FIG. 1.

Referring to FIGS. 1 and 2, a printer 10 has frame means 12 comprising a box-like structure having sidewalls 14, 16 interconnected by a bottom wall 18. A pair of parallel cylindrical carriage guide rods 20, 22 extend parallel to bottom wall 18 between the sidewalls. A carriage means 24 is mounted on the guide rods for translational movement therealong. The body of the carriage comprises a sleeve portion 26 slidably mounted on rod 22 and a yoke member 28 extending toward the front of the printer and having a forked end slidably engaged rod 20 on its upper and lower sides. A generally triangular reinforcing web member 27 of the carriage extends upwardly from sleeve 26 and yoke member 28 normal to the axis of guide rod 22. Also extending upwardly from sleeve portion 26, tangentially of rod 22 and intersecting web member 27, is a generally triangular plate member 29.

A print wheel shaft 30 extends rearwardly from sleeve portion 26 normal to the axis of rod 22. A toothed print wheel drive pulley 32 is rotatably mounted on shaft 30. Connected to pulley 32 for rotation therewith is a print wheel mount 34 for mounting a conventional print wheel 36. An idler pulley 38 is positioned alongside and slightly above shaft 30 for holding a toothed drive belt 40 down against pulley 32. Belt 40 extends parallel to the guide rods between the sidewalls of the printer. It is supported under tension between a drive pulley 42 (see FIG. 4) on the output shaft of a print wheel stepper motor 44 mounted on bracket 45 of sidewall 16 and an idler pulley 46 mounted on bracket 48 of sidewall 14.

A carriage drive belt 50 is connected to the carriage forwardly of sleeve 22, by means of a clamp 51 built into web member 27, and extends parallel to belt 40. Belt 50 is supported under tension between a drive pulley 52 on the output shaft of a carriage stepper motor 54 mounted on a bracket 55 of sidewall 16 and an idler pulley 56 (see FIG. 4) mounted on a bracket 58 of sidewall 14.

Atop the plate member 29 is a cylindrical striker holder 60 mounting a solenoid 62 in vertical position for a hammer 64 actuable by the solenoid 62 to strike a petal of the print wheel near the circumference of such wheel.

Referring to FIG. 2, a platen 66 is positioned parallel to guide rods 20, 22 and elevated so that a vertical tangent of the platen is horizontally adjacent the characters on the circumference of the print wheel and opposite hammer 64. The platen is mounted for rotation about shaft 68 on a generally rectangular rack 70 comprising a pair of parallel side plates horizontally interconnected by shafts 68, 78, 82. The rack is oriented generally vertically and its lower end is pivotally connected between sidewalls 14, 16 by a sleeved motor shaft 72 in left wall 14 and a pivot pin (not shown) in right wall 16, mounted at an elevation below the guide rods. A rearwardly-extending lobe 74 of each of the side plates 71 supports a first paper guide roller 76 which rotates on a shaft 78 below the platen. A second guide roller 80 is mounted for rotation on a shaft 82 at a position above the platen diametrically opposite roller 76. Driving shaft 72 is a platen advance step motor 84 which drives the platen through a belt 86 and pulley 88.

Positioned forwardly and just below the platen adjacent the opposite end plates of the rack are a pair of discs 90 eccentrically mounted on a shaft 92 extending between sidewalls 14, 16 parallel to the platen. The eccentrically mounted discs contact the side plates of the platen rack, which is yieldably biased toward the carriage by a spring (not shown), to fix the distance of the platen from the print wheel. Rotating shaft 92, as indicated by arrow 94, moves the platen toward or away from the print wheel, as indicated by arrow 95. This distance is adjusted for the thickness of paper 98, for example, the number of carbons, supported by the platen, to optimally space the surface of the paper from the characters on the print wheel. The ribbon, indicated by vertical dashed line 96, is positioned between the print wheel and the platen.

Referring to FIGS. 1 and 3, the left sidewall 14 of the frame means is provided with a carriage stop 100 and a print wheel stop 102. Right sidewall 16 is likewise provided with stops 101, 103. The stops are L-shaped members affixed to one or both of the sidewalls 14, 16 of the frame means to provide a reference or initialization position for the carriage and print wheel. The stops 101, 103 mounted on the right wall are mirror images of those shown mounted on left wall 14. Carriage stops 100, 101 are positioned above and parallel to guide rod 22. Each carriage stop has a basic length such that the moving carriage butts against it before print wheel 36 hits the wall. This length is fine tuned, for example, by shimming the stops, so that the carriage abuts the stop when the step motor 54 is centered at a step or stable equilibrium point. Stops 102, 103 are positioned below the guide rods and rearwardly of print wheel 36. They are positioned a distance below print wheel shaft 30 such that radial tab 104 on the print wheel mount angularly abuts the stop when the carriage is moved against stop 100, as indicated by arrow 105, and the print wheel is rotated, as indicated by arrow 106. Their length is adjusted so that tab 104 abuts the stop when motor 44 is centered at a step, a reference character petal of the wheel being angularly aligned with that step.

Carriage and Printer Wheel Drive Arrangement

Referring to FIG. 4, the elements of the carriage and belt drive arrangement are proportioned so that a single step of carriage drive motor 54, moving the carriage sideways, rotates the print wheel 36 mounted on pulley 32 by an amount equal to the rotation produced by stepping the print wheel drive motor 44 an integral number of steps. This requires that the step motors 44, 54 and their respective drive pulleys 42, 52 be proportioned so that:

$$\frac{A}{M} = \frac{K \times B}{N},$$

where K is the aforementioned integral number, A and B are the circumferences of pulleys 52, 42, respectively, and M and N are the number of steps per revolution provided by step motors 54, 44, respectively.

In addition, the print wheel pulley 32 must have a circumference C such that:

$$\frac{B}{N} = \frac{C}{L},$$

L being the number of petals angularly spaced around the circumference of the print wheel.

In an illustrative example, it is desired to index the carriage in increments of 60 steps per inch. Hence, the carriage can be moved 6 steps per character position for 10 character per inch (10 pitch) printing, 5 steps for 12 pitch printing and 4 steps for 15 pitch printing. Accordingly, a suitable carriage drive means comprises a 2° step motor 54, which produces M=180 steps per revolution, driving a drive pulley 52 having a circumference A=3 inches. Moving the carriage a single step toward left wall 14, as indicated by arrow 105, without operating print wheel drive motor 44, rotates print wheel pulley 32 by a proportional amount. For simple logic control, it is desired that the amount of belt movement produced by a step of each motor to be equal, that is, K=1. To offset a single step of movement of pulley 32 caused by motor 54, the print wheel drive means 42, 44 is proportioned to move belt 40 in 1/60 inch increments. At the same time, pulley 32 is sized to rotate the print wheel through one character position per step of motor 44. Wheel 36 is preferably a 96 character print wheel. A suitable print wheel drive motor 44 is a 5° motor, producing 72 steps per revolution and driving a drive pulley 42 having a circumference of 1.2 inches. If motor 44 rotates a single step, it moves belt 40 1/60 of an inch, which is precisely equal to the movement imparted in belt 50 by a single step of carriage drive motor 54. To provide the desired angular rotation of print wheel 36, the circumference of pulley 32 is 1.6 inches. Thus, a single step of motor 44 will rotate the print wheel 36 through a single character position.

As mentioned above, belts 40, 50 and pulleys 42, 52 are toothed. Belt 40 and pulley 42 are preferably 0.08 pitch, or 12.5 teeth per inch, and belt 50 and pulley 52 are preferably 0.20 pitch, that is, 5 teeth per inch. The pitch of the belts and pulleys can be varied without affecting the proportional relationship of the print wheel and carriage drives. The motors and pulleys are angularly aligned so that a step of either motor always vertically positions a character petal of the print wheel. Print wheel motor bracket 45 or pulley 42 can be angularly adjustable to facilitate alignment.

Printer Drive Control

Figure 5:
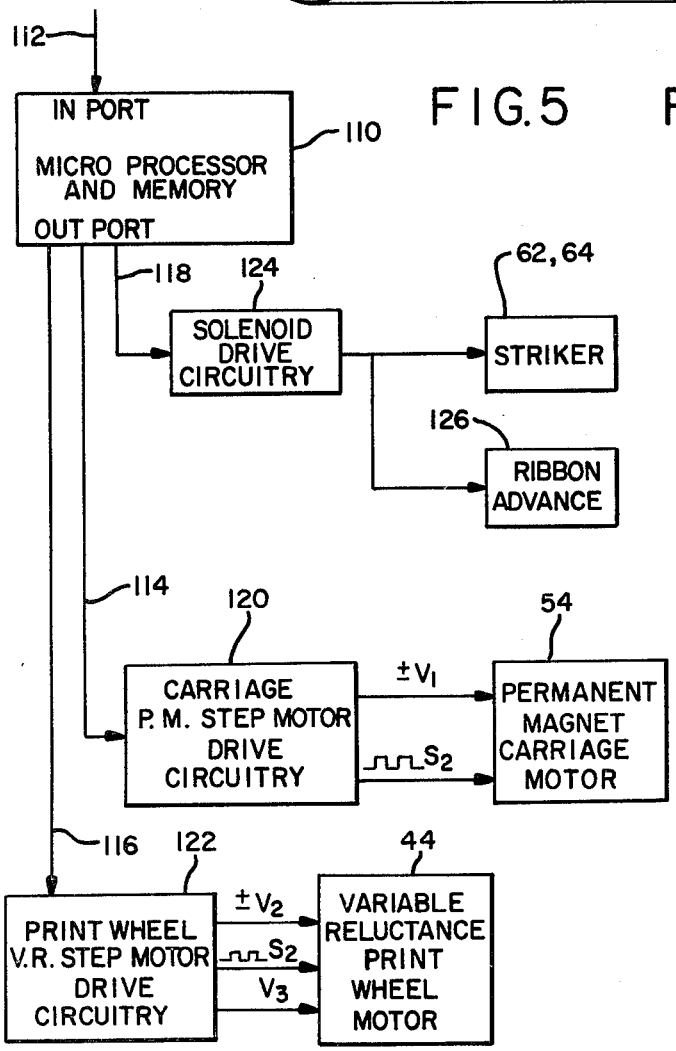
FIG. 5 is a functional block diagram of control circuitry for the printer of FIG. 1.

Referring to FIG. 5, printer 10 is controlled locally by a built-in microprocessor 110 which conventionally includes program and data storage circuitry (not shown). The microprocessor has an 8 bit data communications input port 112 which is conventionally connected to a host computer or microprocessor to provide the textual data to be printed by printer 10. For example, this printer may be used in a word processor system such as that of U.S. Pat. No. 4,145,739 to Dunning, et al. The microprocessor 110 also has three serial output ports 114, 116, 118, controlling the carriage, print wheel, striker and ribbon. A fourth output port (not shown) controlling platen advance motor 84 is also conventionally provided.

Through port 114, the microprocessor 110 provides stepping instructions to carriage step motor drive circuitry 120, which responds by providing a directional control and stepping pulses to carriage motor 54. Motor 54 is preferably a permanent magnet carriage motor and its drive circuitry 120 is a conventional permanent magnet step motor drive circuit such as is disclosed in Sigma Stepping Motor Handbook, published in 1972 by Sigma Instruments, Inc., incorporated by reference herein.

Similarly, via port 116, microprocessor 110 controls print wheel motor drive circuitry 122 which provides a directional voltage and stepping signal to print wheel motor 44. The print wheel motor is preferably a variable reluctance motor to minimize angular inertia and to turn freely during initialization, as described below. Hence, under control of microcomputer 110, drive circuitry 122 conventionally provides an excitation voltage V3 to selected windings of the stator of motor 44 when it is desired to hold the print wheel in a fixed position. Suitable circuitry for drive circuit 122 is disclosed in Guide to Selecting and Controlling Step Motors, published in 1979, by Warner Electric Brake & Clutch Co., Beloit, Wisconsin, incorporated herein by reference.

Through port 118, microprocessor 110 controls conventional solenoid drive circuitry 124, which in turn actuates striker 62, 64. The solenoid drive circuitry can also be used to control a conventional ribbon advance 126. A suitable striker, operable at up to 60 characters per second, is part no. 381814-001 produced by Ledex Inc. of Vandalia, Ohio. As faster strikers become available, they may be substituted, since the print wheel and carriage drive arrangement of printer 10 is operable, independently of the striker, at greater printing speeds.

Microprocessor 110 is controlled by a computer program which is largely conventional. For example, microcomputer 110 can be programmed to operate the printer in the manner of aforementioned U.S. Pat. No. 4,101,006. The microcomputer includes a memory for a table in which the wheel position of each character is mapped against the external or host computer code for that character. This and other conventional aspects of the programming of microcomputer 110 will be readily understood by those skilled in the art of printer programming. However, printer 10 requires several unique routines to coordinate the operation of the carriage and print wheel drives. These routines are described in the next section.

Initialize, Wheel Position and Carriage Move Routines

The overall scheme of the program controlling operation of printer 10 assumes that the carriage and print wheel are in positions known by the microcomputer. As mentioned above, conventional printers require sensing and feedback information to provide this information. In accordance with the invention, two variables, a carriage position indicator (CPI) and a print wheel position indicator (WPI) are initialized, with the carriage and print wheel in a specified position, and continually updated throughout printing.

Figure 6:
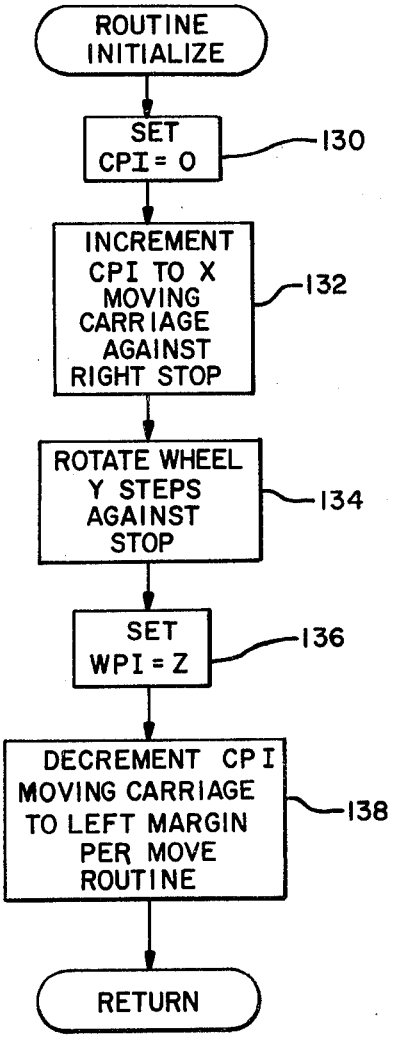
FIG. 6 is a flow chart of the procedure for initializing the printer.

Referring to FIG. 6, routine Initialize is called automatically whenever the printer is started up and as necessary, for example, during maintenance of the printer. The first step in routine Initialize is to set CPI=0, as indicated in flow chart block 130. The next step, shown in block 132, increments CPI to a number X, equal to the number of steps required to drive the carriage the full width of the printer. As the CPI is incremented, the carriage is moved a step at a time toward, for example, the right side of the printer, until the carriage abuts the right carriage step 101. Although the carriage is against the stop, incrementing to the CPI continues until CPI=X. During this operation, the print drive circuitry 122 is de-energized so that the entire daisy wheel drive assembly can move freely with the movement of the carriage.

In the next step, illustrated in block 134, print wheel 44 is stepped Y steps, an amount equal to one revolution of the print wheel, to rotationally engage the print wheel mounting tab 104 against right stop 103. Next, step 136 sets WPI=Z, which corresponds to the number of character positions from which a vertically-positioned reference character is angularly offset from the zero position character, for example, the letter E. (Note: The reference and zero position characters are selected in accordance with the desired character scheme of the wheel and can be the same, in which case Z=0.)

Next, step 138 decrements CPI to a left most starting position provided by the host computer. As CPI is decremented, the carriage is moved to a nominal left margin or starting print position in accordance with the carriage Move routine. As will next be seen, the Move routine updates both the CPI and WPI indicators so that microcomputer 110 always knows where both the carriage and print wheel are positioned as the carriage is moved.

Figure 7:
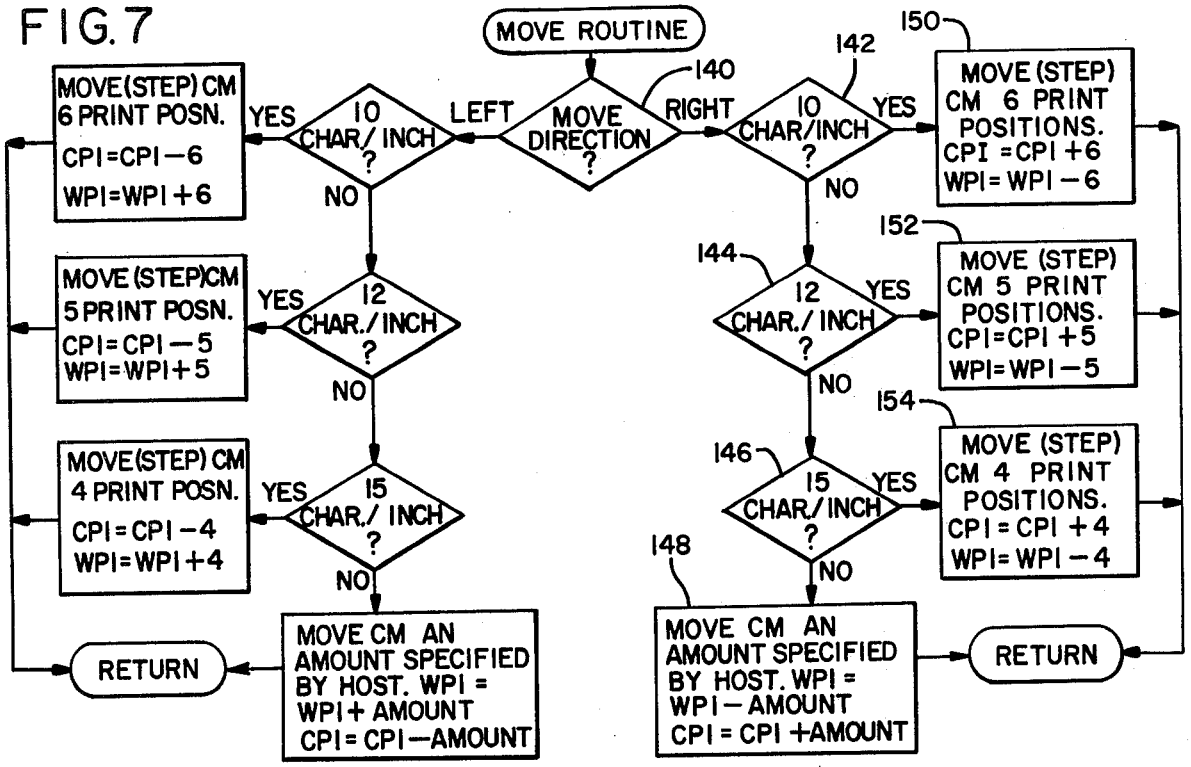
FIG. 7 is a flow chart of the procedure for moving the carriage while varying the synchronous phase relationship of the carriage and print wheel for various character spacings.

Turning to FIG. 7, the Move routine is called automatically whenever the carriage is to be moved. Printer 10 preferably prints in both directions. Hence, the Move routine has two branches, selected by block 140 depending upon the direction in which the carriage is to be moved. Assuming the carriage is positioned at the left margin of the document to be printed, it will be moved to the right to print a character. So, provided a directional indicator from the host computer or the main program in microcomputer 110, block 140 selects the right branch of the routine. That branch provides for three decision blocks 142, 144, 146 which query whether a particular character spacing or print pitch has been selected. If no pitch is selected, the host computer controls the character spacing, as indicated by block 148. If, for example, 10 pitch spacing is specified, step 150 moves the carriage motor 6 steps to the right, incrementing CPI by 6 and decrementing WPI by 6. If 12 or 15 pitch spacing is specified, block 152 or block 154, respectively, is selected to move the carriage 5 or 4 steps, respectively, and to increment CPI and decrement WPI by corresponding amounts.

The selection of block 148 shifts control of the amount of movement to the host computer, but otherwise is identical to block 150, 152, 154. Accordingly, the host computer can move the carriage a single step at a time before printing of graphic material or a variable character spacing for proportional spacing of alpha numeric characters. For example, if proportional spacing is selected by the host computer, the spacing variable, Amount, is determined by the coding for each character. For example, for a medium width letter such as "N," Amount=6 steps; for a wide letter such as "M," Amount=7 steps; and for a narrow letter such as "I," Amount=5 steps. If the Initialize routine is called, and in turn calls the Move routine, Amount=the number of steps that CPI is decremented in block 138 of FIG. 6 to move the carriage to the nominal left margin.

Operation of the left branch of the Move routine is essentially the reciprocal of the right branch. The basic decisional and command blocks are identical except that CPI is decremented and WPI incremented by the amount of leftward steps of the carriage. Once the Move routine is completed and a character is to be printed, the main program in microprocessor 110 shifts control to the Position Wheel routine shown in FIGS. 8*a* and 8*b*.

Figure 8A:
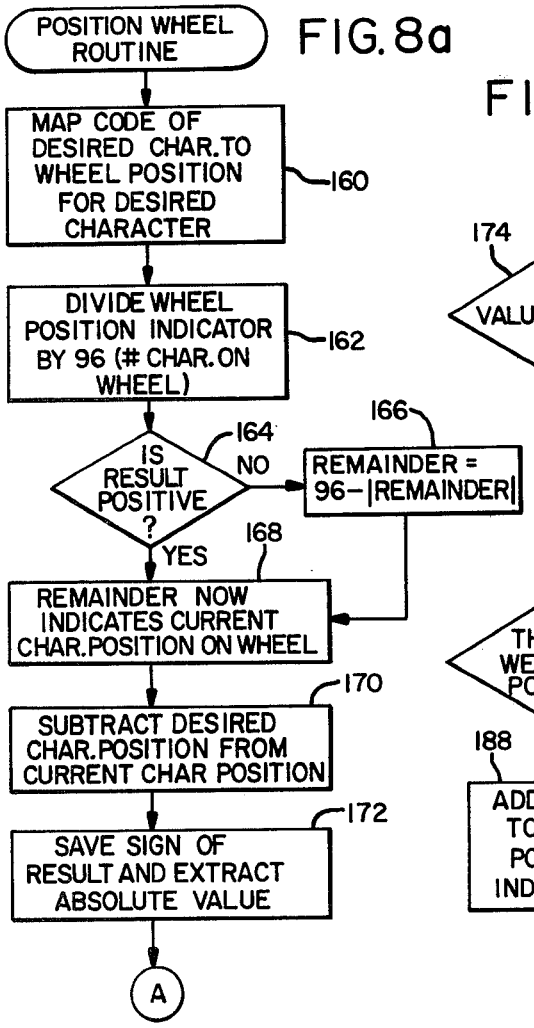
FIGS. 8*a* and 8*b* are a flow charts of the procedure for positioning the print wheel.

Referring to FIG. 8*a*, the first step, illustrated in block 160, is to map the code of a character which is desired to be printed to the wheel position for that character. For a 96 character wheel, the wheel positions are numbered from zero to 95. Next, step 162 is to divide the current value of the wheel position indicator (WPI) by the number of character positions on the wheel, e.g., 96. Depending on the number of cumulative turns of the wheel, the current value of WPI can be either positive or negative. Also, that cumulative value is usually not an integral multiple of the number of characters on the wheel, so division produces a remainder. Accordingly, in the next step, block 164, the sign of WPI is examined to see if it is positive or negative. If it is negative, the remainder is updated to the difference between the number of characters on the wheel, e.g. 96, and the absolute value of the remainder, as shown in block 166. If the remainder is positive, it remains unchanged. In either case, in the next step, block 168, the remainder now indicates the current character position of the wheel.

Next, step 170 is to subtract the desired character position obtained in step 160 from the current character position. The result is the number of steps that the print wheel must be rotated in one direction (indicated by the sign) to position the desired character in the current character or print position. This amount can be greater than half of the circumference of the print wheel and to simply rotate the wheel in the direction indicated in accordance with that value would be nonoptimal. Accordingly, step 172 provides for saving the sign of the result of the subtraction of block 170 and extracting its absolute value of that result as a variable Value.

Figure 8B:
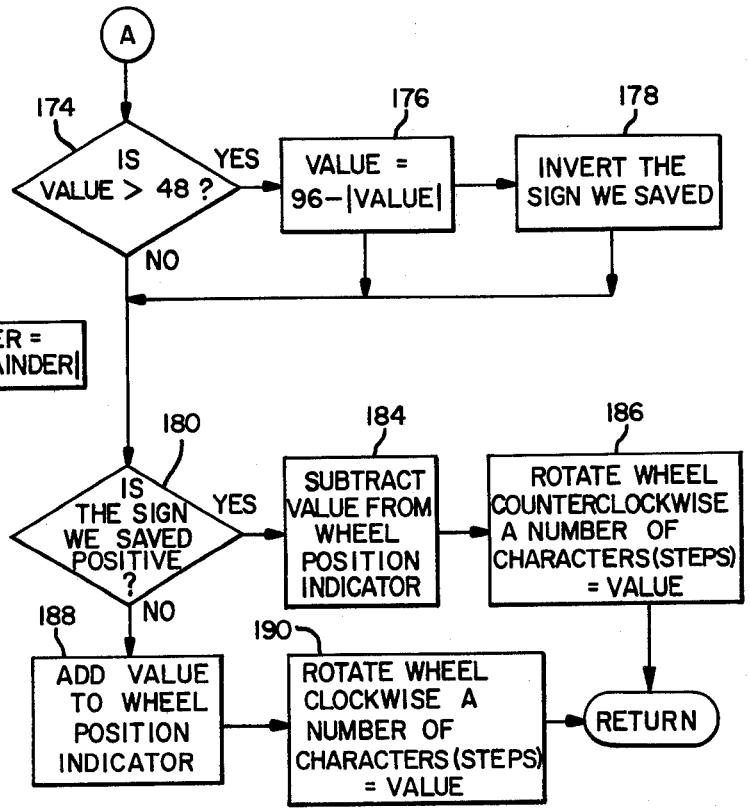

Referring to FIG. 8*b*, which is a continuation of FIG. 8*a*, step 174 queries whether Value is greater than half the number of steps around the circumference of the print wheel, e.g. 48, for a 96 character print wheel. If greater than 48, and therefore nonoptimal, the Value to control the print wheel is set equal to the difference between 96 and the absolute value obtained in block 172. Next, step 178 calls for inverting the sign saved in step 172. If, in block 174, Value is not greater than 48, then Value is optimal and can be used immediately to position the print wheel.

The next step, block 180, which proceeds from either block 174 or block 178, queries whether the sign inverted in step 178 is positive. If it is, step 184 is to update WPI by subtracting Value from the present WPI. In step 186, Value becomes the number of steps used to rotate the print wheel counterclockwise to angularly position the desired character for printing. Returning to step 180, if the saved sign is negative, the steps of blocks 188, 190 are performed. Those steps are the reciprocal of those in blocks 184, 186, respectively: Value is added to WPI and the print wheel is rotated clockwise Value steps.

At this point, the carriage and print wheel are both positioned for printing a character. Next, the microprocessor will conventionally instruct the solenoid drive circuitry to actuate the striker to impact the desired character. Although the foregoing discussion has been in serial form, with the carriage first being positioned, then the print wheel being rotated, it is preferably that these actions be carried out simultaneously. The specific timing of the movement of the carriage relative to the timing and positioning of the print wheel can be varied as needed to maximize overall speed and accuracy of operation. For example, a scheme for controlling carriage velocity in the manner described in the aforementioned Jensen, et al. patent may be used, even though that scheme was designed for an asynchronous printer, whereas printer 10 is essentially synchronous. Likewise, a step ramping scheme can be used to control the rate of acceleration of the motors to increase speed, prevent mechanical resonance, prevent overshoot, and minimize mechanical settling time.

Having illustrated and described the principles of my invention in a preferred embodiment thereof, it should be apparent to those skilled in the art that it may be modified in arrangement and detail without departing from those principles.

I claim as my invention all modifications as come within the spirit and scope of the following claims:

1. A printer comprising:

frame means including a guide means extending from side to side of the frame means;

a carriage mounted for side-to-side movement on the guide means;

a print wheel rotatably mounted on the carriage;

first and second bidirectional stepping motor means mounted on the frame means;

first drive means including a first drive belt connected to the carriage and drivable by the first stepping motor means for indexing the carriage along the guide means to a selected print position, and second drive means including a second drive belt drivingly interconnecting the second motor means and the print wheel for rotating the print wheel to a selected angular position to present a selected print character at said print position;

said belts being arranged so that indexing the carriage induces proportional rotation in the print wheel;

the first drive means being proportioned to the second drive means so that stepping the first stepping means by a single step rotates the print wheel by an amount equal to an amount of wheel rotation resulting from stepping the second stepping motor means an integral number of steps;

the first drive means including a first drive pulley of circumference A on the first motor means, the second drive means including a second drive pulley of circumference B on the second motor means and a print wheel pulley of circumference C drivingly connected to the print wheel;

the first step motor means being operable to produce M steps per revolution;

the second step motor means being operable to produce N steps per revolution;

the first and second drive pulleys being sized so that:

$$\frac{A}{M} = \frac{K \times B}{N},$$

K being said integral number; and the print wheel pulley being sized so that:

$$\frac{B}{N} = \frac{C}{L},$$

L being the number of angular spaced character positions on the print wheel.

2. A printer comprising:

frame means including a guide means extending from side to side of the frame means;

a carriage mounted for side-to-side movement on the guide means;

a print wheel rotatably mounted on the carriage;

first and second bidirectional stepping motor means mounted on the frame means;

first step motor control means for stepping the first motor means a number of steps X and second step motor control means for stepping the second motor means Y+KX steps, K being said integral number and X and Y being variable integers;

first drive means including a first drive belt connected to the carriage and drivable by the first stepping motor means for indexing the carriage along the guide means to a selected print position, and second drive means including a second drive belt drivingly interconnected the second motor means and the print wheel for rotating the print wheel to a selected angular position to present a selected print character at said print position;

said belts being arranged so that indexing the carriage induces proportional rotation in the print wheel;

the first drive means being proportioned to the second drive means so that stepping the first stepping means by a single step rotates the print wheel by an amount equal to an amount of wheel rotation resulting from stepping the second stepping motor means an integral number of steps;

the second control means including means for storing a print wheel position indicator and the first control means including updating means for algebraically adding KX to said indicator as said carriage is moved.

3. A printer according to claim 2 in which the first motor control means includes means for storing a carriage position indicator, the frame means includes first stop means for stopping movement of the carriage at a selected location and second stop means for stopping rotation of the print wheel at a selected angle, and the means for storing includes means for setting said indicators to predetermined values corresponding to said selected location and angle, respectively.

* * * * *